US008635957B2

(12) United States Patent
Orlev et al.

(10) Patent No.: US 8,635,957 B2
(45) Date of Patent: Jan. 28, 2014

(54) PYROPHORIC ARROWS

(75) Inventors: Nahum Orlev, Hod Hasharon (IL); Amir Weitz, Kiryat Tivon (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 310 days.

(21) Appl. No.: 12/867,052

(22) PCT Filed: Feb. 17, 2009

(86) PCT No.: PCT/IB2009/050646

§ 371 (c)(1),
(2), (4) Date: Aug. 11, 2010

(87) PCT Pub. No.: WO2009/104134

PCT Pub. Date: Aug. 27, 2009

(65) Prior Publication Data

US 2010/0307364 A1 Dec. 9, 2010

(30) Foreign Application Priority Data

Feb. 19, 2008 (IL) ..... 189612

(51) Int. Cl.
*F42B 12/44* (2006.01)

(52) U.S. Cl.
USPC ..... 102/402; 102/364; 89/1.13

(58) Field of Classification Search
USPC ..... 102/364, 393, 402, 438, 700, 703; 89/1.13; 86/50
See application file for complete search history.

(56) References Cited

U.S. PATENT DOCUMENTS

| | | | | | |
|---|---|---|---|---|---|
| 4,019,932 | A | * | 4/1977 | Schroeder | 149/19.1 |
| 4,096,804 | A | * | 6/1978 | Bilsbury | 102/364 |
| 4,237,787 | A | * | 12/1980 | Wacula et al. | 102/501 |
| 4,318,343 | A | * | 3/1982 | King | 102/365 |
| 4,419,936 | A | * | 12/1983 | Coates et al. | 102/364 |
| 4,462,312 | A | * | 7/1984 | Cahannes et al. | 102/364 |
| 4,625,650 | A | | 12/1986 | Bilsbury | |
| 4,662,280 | A | * | 5/1987 | Becker et al. | 102/364 |
| 4,922,826 | A | * | 5/1990 | Busch et al. | 102/489 |
| 5,076,169 | A | * | 12/1991 | Jeanquartier et al. | 102/364 |
| 5,121,691 | A | * | 6/1992 | Nicolas | 102/364 |
| 5,131,329 | A | * | 7/1992 | Lips et al. | 102/364 |
| 5,164,533 | A | * | 11/1992 | Schluckebier | 86/20.14 |
| 5,189,248 | A | * | 2/1993 | Deffayet et al. | 102/386 |
| 5,259,317 | A | * | 11/1993 | Lips | 102/307 |
| 5,341,745 | A | * | 8/1994 | Strandli et al. | 102/499 |
| 5,501,153 | A | * | 3/1996 | Cassagne et al. | 102/307 |
| 5,820,072 | A | * | 10/1998 | Na et al. | 244/49 |
| 5,852,256 | A | * | 12/1998 | Hornig | 102/473 |

(Continued)

FOREIGN PATENT DOCUMENTS

| | | |
|---|---|---|
| DE | 649530 | 8/1937 |
| DE | 655739 | 1/1938 |

*Primary Examiner* — Benjamin P Lee
(74) *Attorney, Agent, or Firm* — Mark M. Friedman

(57) ABSTRACT

An arrow-type warhead (100,200,300,400,500,600,700) comprises an envelope (102,202), a filling (108), a hardened head section (104) to promote penetration of the target and a stabilizing mechanism (106,210,302,402,502,602) to stabilize the warhead in flight, hi some embodiments the filling (108) is pyrophoric and undergoes an exothermic reaction with the envelope upon impact. In other embodiments the filling is incendiary and undergoes reaction with the envelope upon impact in an oxygen rich-environment. In yet other embodiments, the filling is explosive. In all embodiments, the warhead may be equipped with a mini-rocket propulsion mechanism (802) for propelling the warhead to the target.

16 Claims, 14 Drawing Sheets

(a)

(d)

(56) References Cited

U.S. PATENT DOCUMENTS

| | | | | |
|---|---|---|---|---|
| 5,959,235 | A * | 9/1999 | Wagstaff | 102/202 |
| 6,105,505 | A * | 8/2000 | Jones | 102/364 |
| 6,354,222 | B1 * | 3/2002 | Becker et al. | 102/513 |
| 6,540,175 | B1 | 4/2003 | Mayersak | |
| 6,546,838 | B2 * | 4/2003 | Zavitsanos et al. | 89/1.13 |
| 6,679,176 | B1 * | 1/2004 | Zavitsanos et al. | 102/364 |
| 6,691,622 | B2 * | 2/2004 | Zavitsanos et al. | 102/364 |
| 6,748,842 | B1 | 6/2004 | Guirguis | |
| 6,945,175 | B1 * | 9/2005 | Gotzmer et al. | 102/364 |
| 7,278,356 | B1 * | 10/2007 | Geisler et al. | 102/364 |
| 7,383,775 | B1 * | 6/2008 | Mock et al. | 102/363 |
| 7,530,315 | B2 * | 5/2009 | Tepera et al. | 102/393 |
| 7,845,282 | B2 * | 12/2010 | Sheridan et al. | 102/473 |
| 7,886,668 | B2 * | 2/2011 | Hugus et al. | 102/517 |
| 7,891,297 | B1 * | 2/2011 | Rohr | 102/492 |
| 8,001,879 | B2 * | 8/2011 | Williams et al. | 86/54 |
| 8,033,223 | B2 * | 10/2011 | Sheridan et al. | 102/473 |
| 8,074,572 | B1 * | 12/2011 | Bland et al. | 102/489 |
| 8,127,683 | B2 * | 3/2012 | Tepera et al. | 102/351 |
| 2003/0034102 | A1 * | 2/2003 | Thiesen et al. | 149/19.6 |
| 2003/0051629 | A1 | 3/2003 | Zavitsanos | |
| 2006/0048666 | A1 | 3/2006 | Radchenko | |
| 2012/0067242 | A1 * | 3/2012 | Shin et al. | 102/364 |

* cited by examiner

400

(a)

PYROPHORIC ARROWS

RELATED APPLICATIONS

This patent application is a U.S. National Phase Application of PCT/IB2009/050646 filed on Feb. 17, 2009, which claims priority of Israeli Patent Application No. 189612 filed Feb. 19, 2008, the contents of which are incorporated herein by reference.

FIELD OF THE INVENTION

The present invention relates in general to small sub-munitions or warheads and in particular to flechette, dart or arrow-type warheads used to neutralize various target objects such as mines, improvised explosive devices (IEDs). unexploded ordnance and flying projectiles, missiles or rockets.

BACKGROUND OF THE INVENTION

Systems that employ penetrating devices to defeat unexploded ordnance and/or buried land mines are known. Particularly pertinent to the invention are projectiles such as flechettes, darts or arrows (referred to generally hereinafter as "arrows") designed to penetrate through dirt, sand, and/or water as well as the casing of targets such as unexploded ordnance or buried land mines, in order to deliver a payload designed to neutralize the explosive material within these targets. These devices use kinetic energy to "break-up" or fracture the explosive material within the target, allowing a neutralizing agent to contact the fractured explosive material. The neutralizing agent is normally some type of material that will burn the explosive material in the target but not detonate it (for example, the hot decomposition products of a propellant) or chemically react with the explosive in the mine in order to complete its neutralization.

Small incendiary or pyrophoric arrows are known. For example, U.S. Pat. No. 4,625,650 discloses an explosive incendiary projectile equipped with a hollow cylindrical as well as aerodynamically configured copper jacket having a tubular penetrator consisting of a heavy metal with an explosive charge. With consideration to the relatively small caliber (12.7 mm), a sufficient penetrating effect with additional lateral effect is alone not achievable due to physical reasons.

U.S. Pat. No. 6,540,175 discloses a dart having an elongated body with a high temperature incendiary fill, a nose section shaped to provide cavitation upon passing through a displaceable mass, firing means including an axially displaceable firing pin operative upon contact with a non-displaceable mass, and a fulminate primer activated by said firing pin communicating with said fill. The high temperature incendiary fill candidates include titanium-boron-Teflon with CTBN as the binder, titanium-boron-Teflon with VitonA as the binder, titanium-boron with ammonium perchlorate with VitonA as the binder, aluminum potassium perchlorate with VitonA as the binder and aluminum iron oxide with VitonA as the binder.

U.S. Pat. No. 6,748,842 discloses a kinetic energy driven projectile for defeating unexploded ordnance or buried land mines. This projectile has been developed to address the specific problem with similar devices in that the kinetic energy by itself does not sufficiently fracture the explosive material within a mine in order to fully defeat the mine. This invention adds a small amount of insensitive high explosive material that is cap sensitive to one tip of the projectile, along with a novel initiation mechanism, so that the detonation of the high explosive material can more fully fracture the explosive material within a mine. This allows a neutralization agent to completely react with all of the explosive material within the mine, thereby consuming the entire fill.

Projectiles that contain a relatively small amount of incendiary or explosive composition cause relatively small resultant explosions or reactions. Additionally, because the incendiary or explosive composition is configured to ignite substantially simultaneously with the impact of the projectile on a target, the explosion or other reactions are often complete before they can inflict substantial additional damage to the target.

There is therefore a need for, and it would be advantageous to have arrows that do not suffer from these disadvantages.

SUMMARY OF THE INVENTION

The present invention relates to arrow-type warheads, in particular pyrophoric warheads. In contrast with all known arrows, pyrophoric arrows of the present invention have an incendiary envelope that is consumed in a reaction with a pyrophoric or incendiary filling upon impact.

According to the present invention there is provided an arrow-type warhead including an incendiary envelope and a filling disposed within the envelope and primed to undergo a reaction with the envelope upon impact of the arrow on a target, whereby both envelope and filling are consumed in the reaction to provide a desired destructive effect.

In some embodiments, the filling includes a pyrophoric material in the form of a metal oxide and a metal powder.

In some embodiments, the filling includes a pyrophoric material in the form of a metal oxide and a metal powder.

In some embodiments, the metal is aluminum or magnesium, the oxide is respectively an aluminum or a magnesium oxide and the envelope is made of respectively aluminum or magnesium.

In some embodiments, the metal oxide has a composition above the stoichiometric ratio, thereby leading to an exothermic reaction.

In some embodiments, the filling is incendiary and operative to undergo the reaction with the envelope in an oxygen-rich environment.

In some embodiments, the warhead further includes a hardened head section for promoting penetration of the target, a stabilizing mechanism for stabilizing the warhead in flight and an igniter mechanism for setting off the pyrophoric material.

In some embodiments, the envelope and the stabilizing mechanism form a unibody structure.

In some embodiments, the stabilizing mechanism includes a fixed fin structure.

In some embodiments, the stabilizing mechanism is selected from the group consisting of a stabilizing cup, a stabilizing cone, a stabilizing band and centrifugal foldable radial fins.

In some embodiments, the warhead further includes a stopping mechanism disposed to stop the warhead at a predetermined position relative to the target upon impact.

In some embodiments, the stopping mechanism is selected from the group consisting of a spring mechanism and a collapsible tail mechanism.

In some embodiments, the warhead further includes a mini-rocket propulsion mechanism for propelling the warhead to the target.

According to the present invention there is provided an arrow-type warhead including an envelope, an explosive filling, a hardened head section for promoting penetration of the target and a stabilizing mechanism for stabilizing the warhead in flight.

According to the present invention there is provided an arrow-type warhead including a unibody structure defined by an elongated envelope having a hardened head section at one end and an integrated stabilizing mechanism at an opposite end and a filling disposed within the envelope and primed to undergo an exothermic reaction with the envelope upon impact of the head section on a target, thereby causing target destruction.

BRIEF DESCRIPTION OF THE DRAWINGS

For a better understanding of the present invention and to show more clearly how it could be applied, reference will now be made, by way of example only, to the accompanying drawings in which:

FIG. 7(*e*) shows an embodiment of an arrow having a collapsing tail stopping mechanism;

DETAILED DESCRIPTION OF THE INVENTION

The present invention relates to arrows having a wide variety of structures. In some embodiments, the arrows are pyrophoric. In other embodiments, the arrows are explosive. A pyrophoric arrow includes an incendiary envelope with a pyrophoric or incendiary filling contained therewithin, the incendiary envelope and the filling being consumed through a reaction upon impact. In some embodiments, either pyrophoric, or explosive, the arrows include an inventive unibody structure having an integrated stabilizing mechanism. In some embodiments, the arrows include inventive stabilizing and penetration stopping mechanisms. In all embodiments, the arrows receive kinetic energy from a delivery vehicle (bomb, rocket, missile, bullet sleeve). The arrows penetrate their intended target due to this kinetic energy. Various arrow delivery vehicles that can be used with the arrows of the present invention are well known in the art. In some embodiments, the arrow is part of a mini-rocket.

Figure 1:
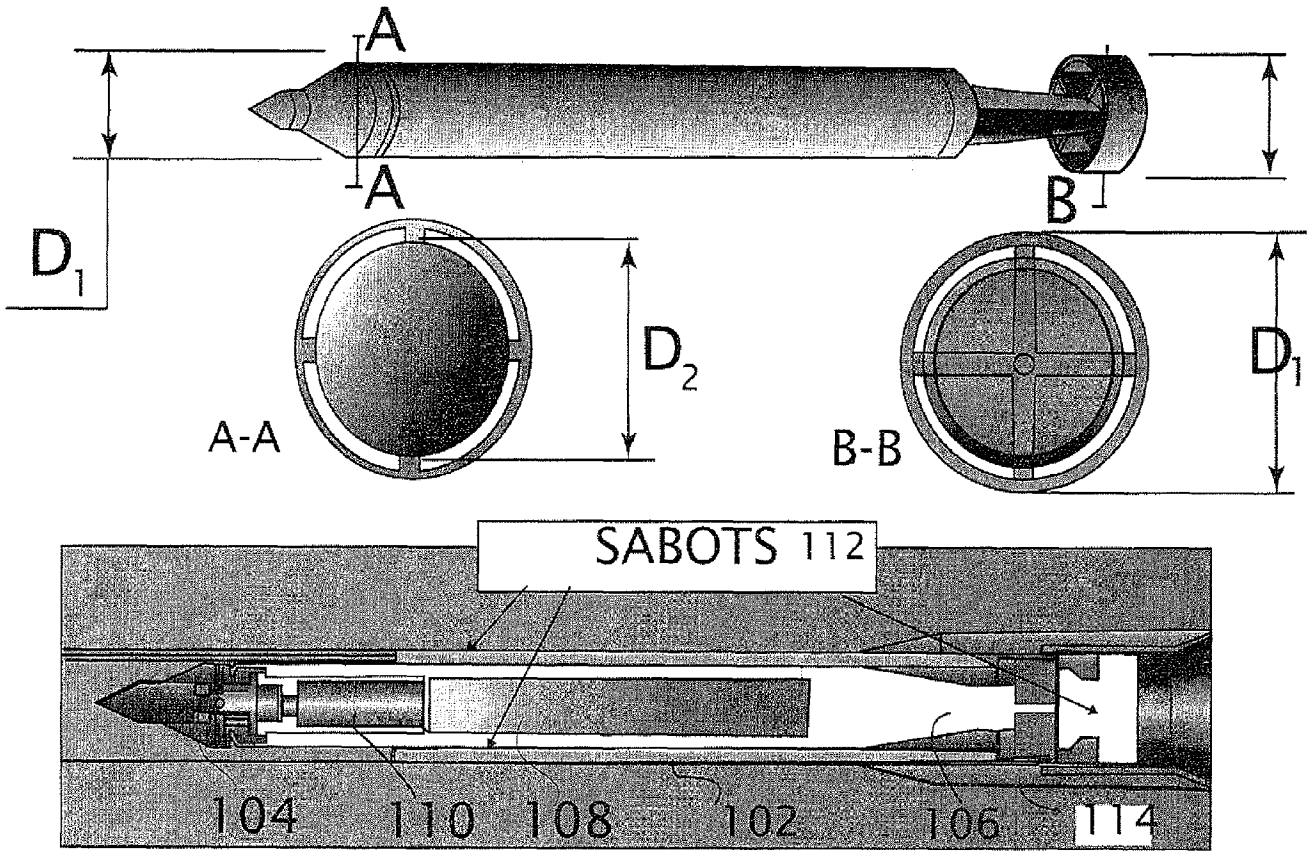
FIG. 1 shows an embodiment of an arrow of the present invention having a fin stabilizing mechanism.

FIG. 1 shows an embodiment of an arrow 100 of the present invention having a first type of stabilizing mechanism. Arrow 100 includes an elongated, partially hollow envelope 102 ending in (or attached to) a hardened head section 104 at one end and a stabilizing mechanism 106 at an opposite end. Envelope 102 has typically either a round cross section with a diameter $D_1$ (see radial cross section B-B) or a polygonal cross-section. Head section 104 typically has a starting smaller diameter $D_2$ (see radial cross section A-A). In some embodiments in which the arrows are referred to as "pyrophoric arrows", envelope 102 is made exemplarily of a material such as aluminum (Al) or magnesium (Mg). In other embodiments in which the arrows are referred to as "explosive arrows", envelope 102 may be made of regular steel, stainless steel (SS), copper, brass or other similar materials. In all embodiments, envelope 102 encloses a filling 108. In pyrophoric arrows, the filling is pyrophoric or incendiary. In explosive arrows, the filling is explosive. In pyrophoric and incendiary arrows, filling 108 is made of a material in the form of a mixture of a metal oxide (MA) and a metal powder, for example a mix of $M_xO_y$ and aluminum, or $M_xO_y$ and magnesium (Mg). A pyrophoric filling is metal sub-stoichiometric, in the sense of being deficient in metal and rich in oxygen. An incendiary filling is stoichiometric. The metal powders may be mixed with a binder to form a solid reactant. The metal in the oxide may exemplarily be Fe, $Co_5$ Mn, Cu, Zn, Cr, Mg, Ni, Zr or Ti, etc. Multi-metal oxide compounds (e.g. $Al_xMg_yO_z$) known to undergo reactions with Al or Mg may also be used as material 108. Additives such as Ni may be added to the metal (e.g. Al or Mg) to enhance the efficiency of the reaction between filling and envelope.

In pyrophoric or incendiary arrows, the metal oxide undergoes an exothermic reaction with the envelope (in addition with undergoing a reaction with the metal powder). The envelope is therefore referred to accordingly as being an "incendiary envelope". Exemplary, for an Mg envelope and a copper oxide filling, the reaction may be as follows $$Mg_{(0)}+C_xO_y=MgO+Cu_{(0)}$$

In pyrophoric arrows, the consummation of the envelope is due to the sub-stoichiometry of the filling, since the oxygen-rich filling requires more metal than available in the metal powder. The sub-stoichiometry can be calculated exactly to provide the required effect. In embodiments of a pyrophoric arrow in which the metal oxide is stoichiometric, the filling and envelope may be consumed in a reaction that occurs in an oxygen-rich environment as the arrow encounters high friction at high velocity. Such arrows may be called "incendiary arrows". The envelope is ignited upon impact by the high velocity/high friction, O-rich conditions. These conditions lead to the reactions cited above without a need for the filling sub-stoichiometry requirement, since the oxygen rich environment requires more metal consumption than available in the filling. Incendiary filling candidates for stoichiometric fillings may include the fillings disclosed in U.S. Pat. No. 6,540,175, i.e. titanium-boron-Teflon with CTBN as the binder, titanium-boron-Teflon with VitonA as the binder, titanium-boron with ammonium perchlorate with VitonA as the binder, aluminum potassium perchlorate with VitonA as the binder and aluminum iron oxide with VitonA as the binder.

In general, the consumption of an incendiary envelope in the exothermic reaction with the filling is a key inventive feature of the pyrophoric and incendiary arrows disclosed herein. It is emphasized that in contrast with prior art incendiary arrows that use the same materials as the incendiary arrows of the present invention, in incendiary arrows of the present invention the envelope is consumed in the reaction, thereby providing a key inventive feature.

In explosive arrows, filling 108 is made of an explosive material. Exemplarily, the material may be a mixture of 93% PETN and 7% WAX. Other explosive materials that can fit the diameter and volume limitations can also be used.

An arrow of the present invention, either pyrophoric, incendiary or explosive, further includes an igniter mechanism 110, operative to ignite the pyrophorie filling or to set off the explosive filling. The igniter may consist of gunpowder encapsulated and activated by a standard bullet pica. Mechanism 110 may be positioned at either end of the pyrophoric or explosive filling inside the envelope. Such mechanisms are well known in the art, see for example the dart ignition system in U.S. Pat. No. 6,540,175 to Mayersak et al. The arrow may further include sabots 112 for positioning adjustments within the envelope and tail section. Exemplarily, the sabots may allow use of a standard bullet cartridge as a delivery vehicle for an arrow by adjusting the arrow to a standard bullet jacket 114.

Figure 2:
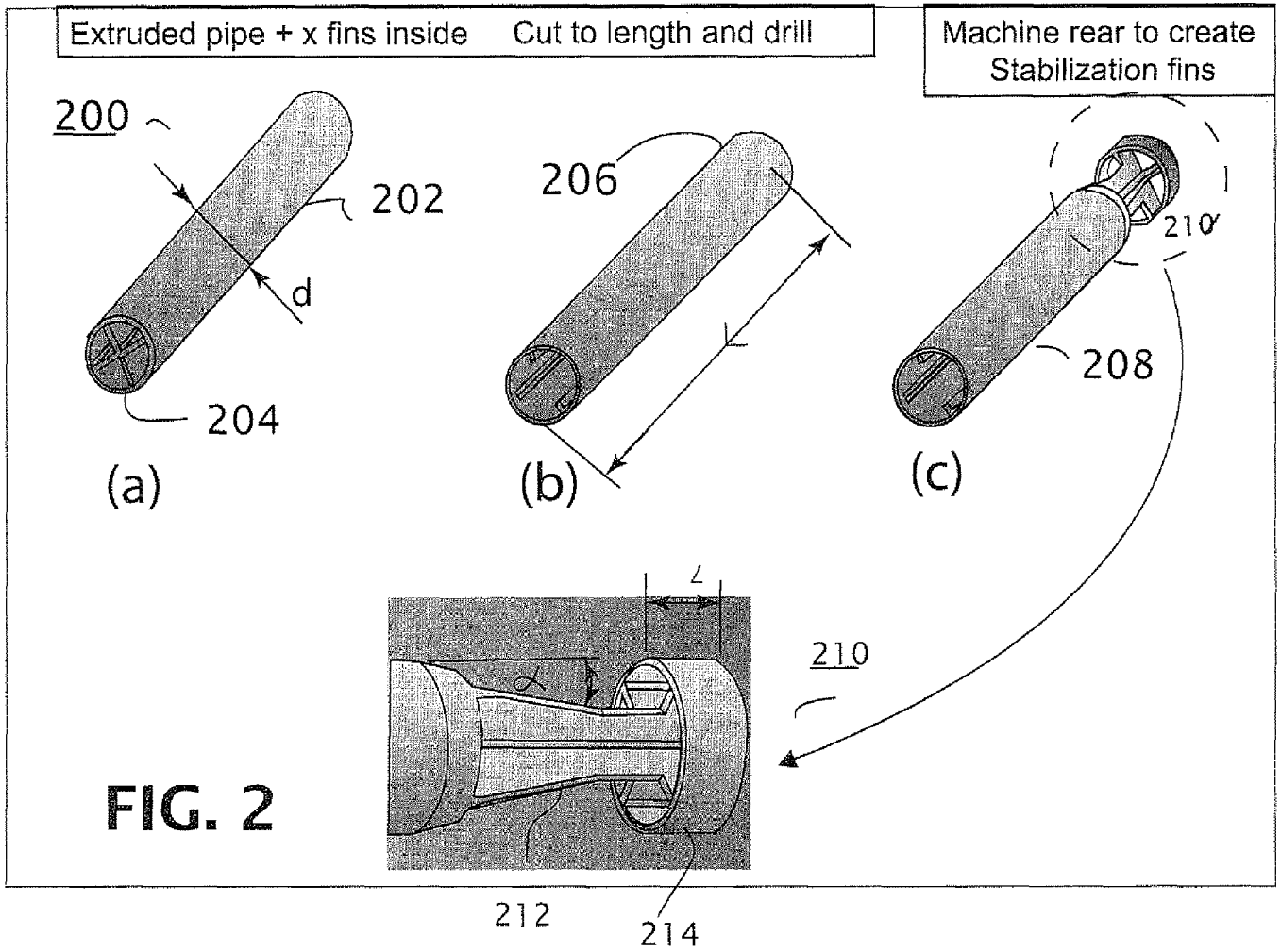
FIG. 2 shows a unibody structure of the embodiment of FIG. 1: (a) in a first manufacturing stage, (b) in a second manufacturing stage that removes internal fins, and (c) in a third manufacturing stage that provides the stabilizing mechanism.

Externally, the structure of arrow 100 may resemble known arrow structures, see. e.g. the flechette shanks disclosed in U.S. Pat. No. 4,922,826 to Busch et al. In same embodiments, the envelope and the stabilizing mechanism form a unibody structure. FIG. 2 shows such a unibody structure 200 at three stages of formation. In other embodiments, the stabilizing mechanism may assume a variety of shapes and functions, which are explained in detail below.

FIG. 2*a* shows a unibody structure 200 with a hollow envelope 202 having an internal cross fin structure 204 in a first manufacturing stage. The envelope is shown with an exemplary cylindrical shape. Structure 200 can be made for example by extrusion of a long Al tube, which can then be cut to size. Exemplary Al materials may be 6061-t6, 6063-t6 and 7075-t3. The structure dimensions may vary according to the application. In some embodiments, D may be between ca. 6-25 mm and L may be between ca. 50-250 mm. Yet other diameters and lengths may be employed for other applications. More generally, the structure dimensions can be defined as having a ratio UD between ca 2-42. The dimensions cited are exemplary and not meant to be restrictive.

FIG. 2*b* shows structure 200 after removal of the internal fin structure from the entire cylinder (e.g. by drilling) except for a tail section 206. FIG. 2*c* shows unit 200 after a machining step that removes part of the envelope and the internal fin structure in tail section 206, thereby dividing envelope 202 into a main section 208 and an "integrated" stabilizing mechanism 210. FIG. 2*d* shows an enlargement of stabilizing mechanism 210. Mechanism 210 includes a sloped, fixed fin section 212 and a cylindrical section 214. Section 212 may be formed by machining (e.g. by lathe) the envelope and the internal fins so that the machined fins form an angle $\alpha$ (exemplarily $15^{0}$) with an aft end 214 of main section 208. Aft end 214 has a length $L_t$. The simple extrusion and machining steps needed to make the unibody structure are particularly suitable for mass production and therefore particularly advantageous.

In some embodiments, the arrow (pyrophoric or explosive) may have different stabilizing mechanisms. In one embodiment shown in FIG. 3, the stabilizing mechanism is a stabilizing cup. In another embodiment shown in FIG. 4, the stabilizing mechanism is a stabilizing cone. In yet another embodiment shown in FIG. 5, the stabilizing mechanism is a stabilizing band. In yet another embodiment shown in FIG. 6, the stabilizing mechanism includes centrifugal foldable radial fins.

Returning now to FIG. 3, the figure shows an arrow 300 with a stabilizing cup 302 in a rest (non-flight) state in three views: (a) external; (b) longitudinal cross section A-A and (c) radial cross section B-B. Stabilizing cup 302 replaces in function stabilizing mechanism 210 (FIG. 2). As shown in view (b), the arrow includes a breakable (upon impact) capsule 304. The capsule may be either a one-part capsule or a two-part capsule. A one-part capsule contains either a liquid mineral oil such as glycerol or an oxidizing powder agent such as potassium permanganate, with the envelope containing a complementary reacting agent. A two part capsule contains in one part either the mineral oil or the oxidizing powder agent and in the other part the complementary reacting agent. The capsule is coupled at one end through a metal disk 306 to a filling 308, and at another end through a bushload 310 to stabilizing cup 302. The bushload's function is to isolate the capsule from the burning material and to allow breaking of the capsule upon impact. Cup 302 is connected to the bushload through a plurality of elongated elements 312. The bushload and the capsule are attached exemplarily by a threaded connection 314. Cup 302 has an aerodynamic shape (e.g. hemispherical) that allows it to be lifted (extended) from the arrow body in flight. Cross section B-B indicates that elements 312 are inside the arrow and do not extend out of the envelope.

FIG. 3*d* shows in longitudinal cross section arrow 300 in flight (in the air), wherein an air flow lifts and pulls cup 302, bushload 310 and capsule 304 away from filling 308. Upon impact of the arrow (head) into a target, the cap, bushload and capsule are accelerated toward the filling, pushing the capsule toward the metal disk and causing the capsule content to spill (due to impact on the disk) and ignite the pyrophoric material.

It would be clear to one skilled in the art that there may be many ways to design the cup and its connection to the capsule and arrow in order to achieve the desired results set forth herein. These ways may include variations in geometry, shapes, dimensions, connecting elements and materials.

Figure 3:
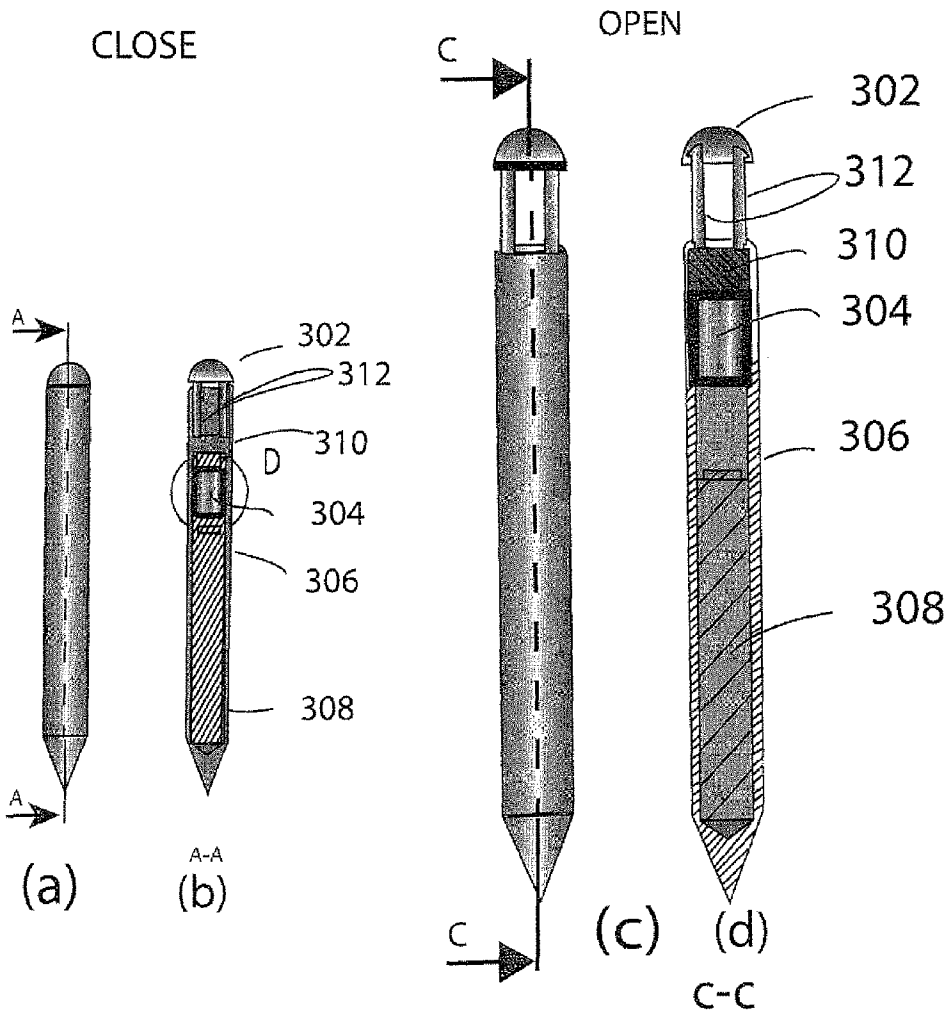
FIG. 3 shows an embodiment of an arrow having a stabilizing cup in a rest (non-flight) state in three views: (a) external, (b) longitudinal cross section and (c) radial cross section, and the same arrow in flight (d)
Figure 4:
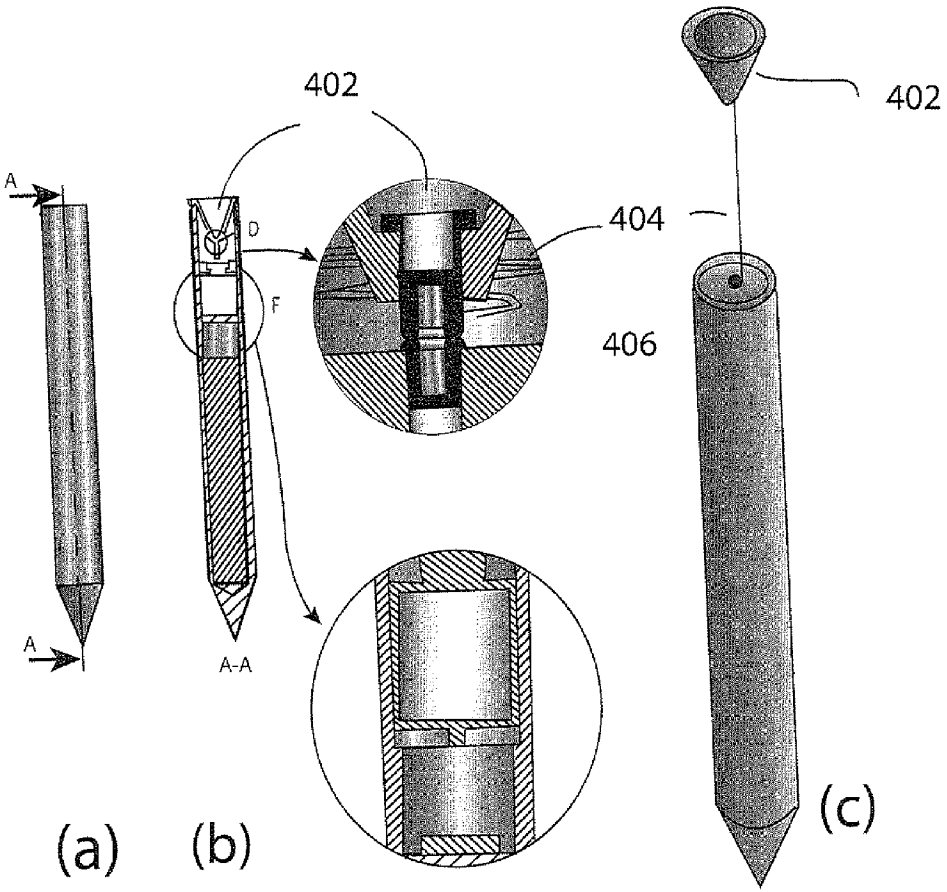
FIG. 4 shows an embodiment of an arrow having a stabilizing cone in a rest (non-flight) state in two views: (a) external and (b) longitudinal cross section; (c) shows the same arrow in flight.

FIG. 4 shows an arrow 400 with a stabilizing cone 402 at rest (non-flight) in (a) external and (b) longitudinal cross section. The same arrow is shown in flight in FIG. 4(*c*). The cone fulfills essentially the same function as cup 302, i.e. to pull away the capsule in flight and allow the capsule to accelerate and spill upon impact, thereby igniting the filling. The main difference vs. the embodiment in FIG. 3 is the connection between the cone and the capsule: the cone is connected to the capsule by a wire 404. At rest, the wire is coiled inside a space 406 defined by the cone and the arrow envelope. In flight, the cone is removed by aerodynamic forces (air flow) from the arrow, extending the wire and pulling the capsule away from the filling. Upon impact of the arrow into a target, the capsule is accelerated toward the filling, ruptures in its impact against the metal disk and causes the capsule contents to spill and ignite the pyrophoric material. An added advantage of a cone stabilized arrow is the possibility to stack such arrows efficiently for storage purposes: the cone my be designed to fit exactly the external head section, such that the head of one arrow can fit into the cone tail of another arrow.

It would be clear to one skilled in the art that there may be many ways to design the cone and its connection to the capsule and arrow in order to achieve the desired results set forth herein. These ways may include variations in geometry, shapes, dimensions, connecting elements and materials.

Figure 5:
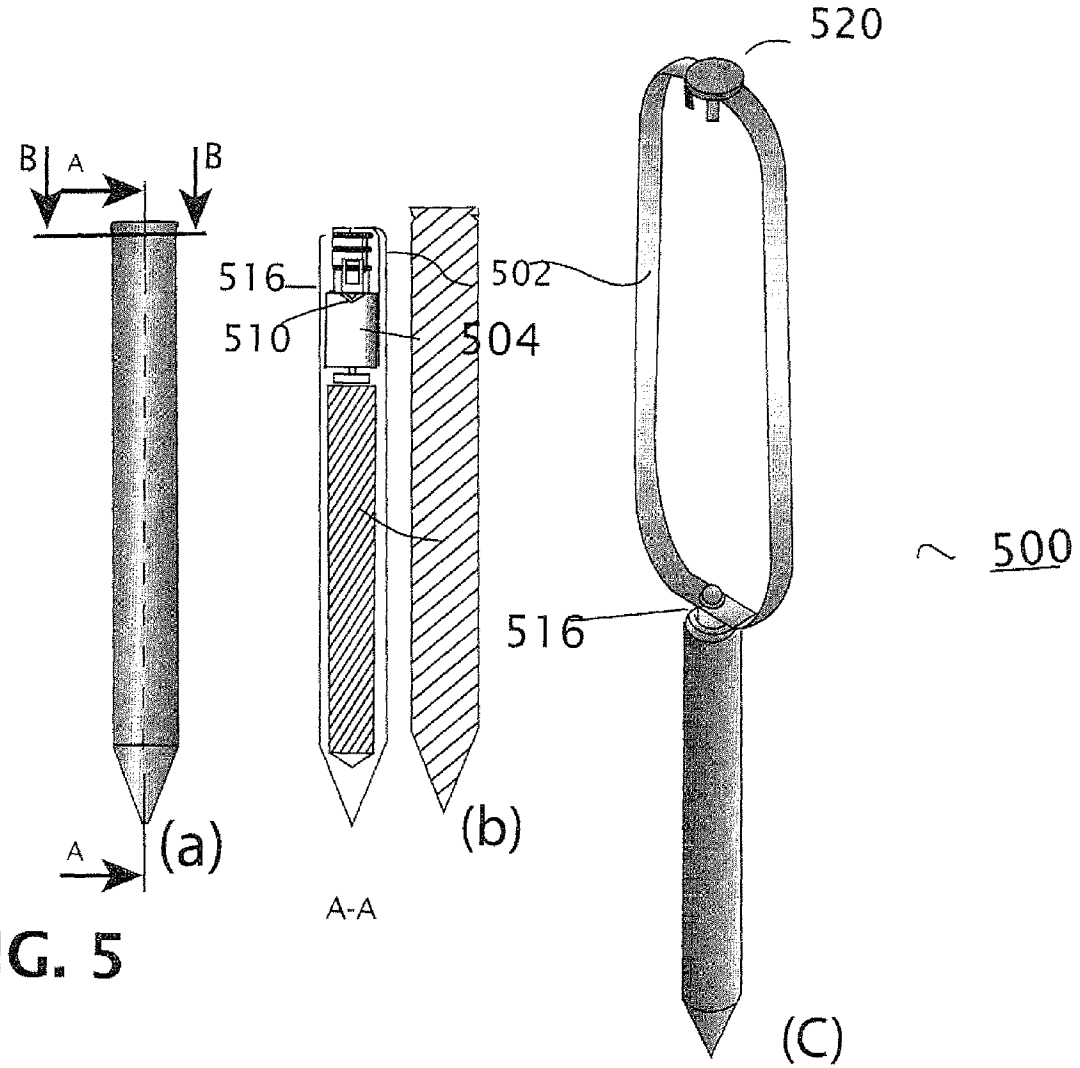
FIG. 5 shows an embodiment of an arrow having a stabilizing band in; (a) external view at rest, (b) longitudinal cross-section at rest and (c) external view in flight.

FIG. 5 shows an embodiment of an arrow 500 having a stabilizing band 502 in (a) an external view at rest, (b) a longitudinal cross-section at rest, and (c) an external view in flight. The stabilizing band replaces in function stabilizing mechanism 210 (FIG. 2) or stabilizing cup 302 (FIG. 3). The band may be made of materials well known in the art. Arrow 500 includes the same elements as arrow 300 except that a capsule 504 is now connected through a bushload 510 and a rivet 516 to band 502. At rest, the band is positioned within the envelope of the arrow, such that the arrow is plugged at its aft end by a plug 520. In flight, the plug is removed by aerodynamic forces (air flow) from the arrow, extending the band and pulling the capsule away from the filling. Upon impact of the arrow into a target, the capsule is accelerated toward the filling, ruptures in its impact against the metal disk and causes the capsule content to spill and ignite the pyrophoric material.

It would be clear to one skilled in the art that there may be many ways to design the band and its connection to the capsule and arrow in order to achieve the desired results set forth herein. These ways may include variations in geometry, shapes, dimensions, connecting elements and materials.

Figure 6:
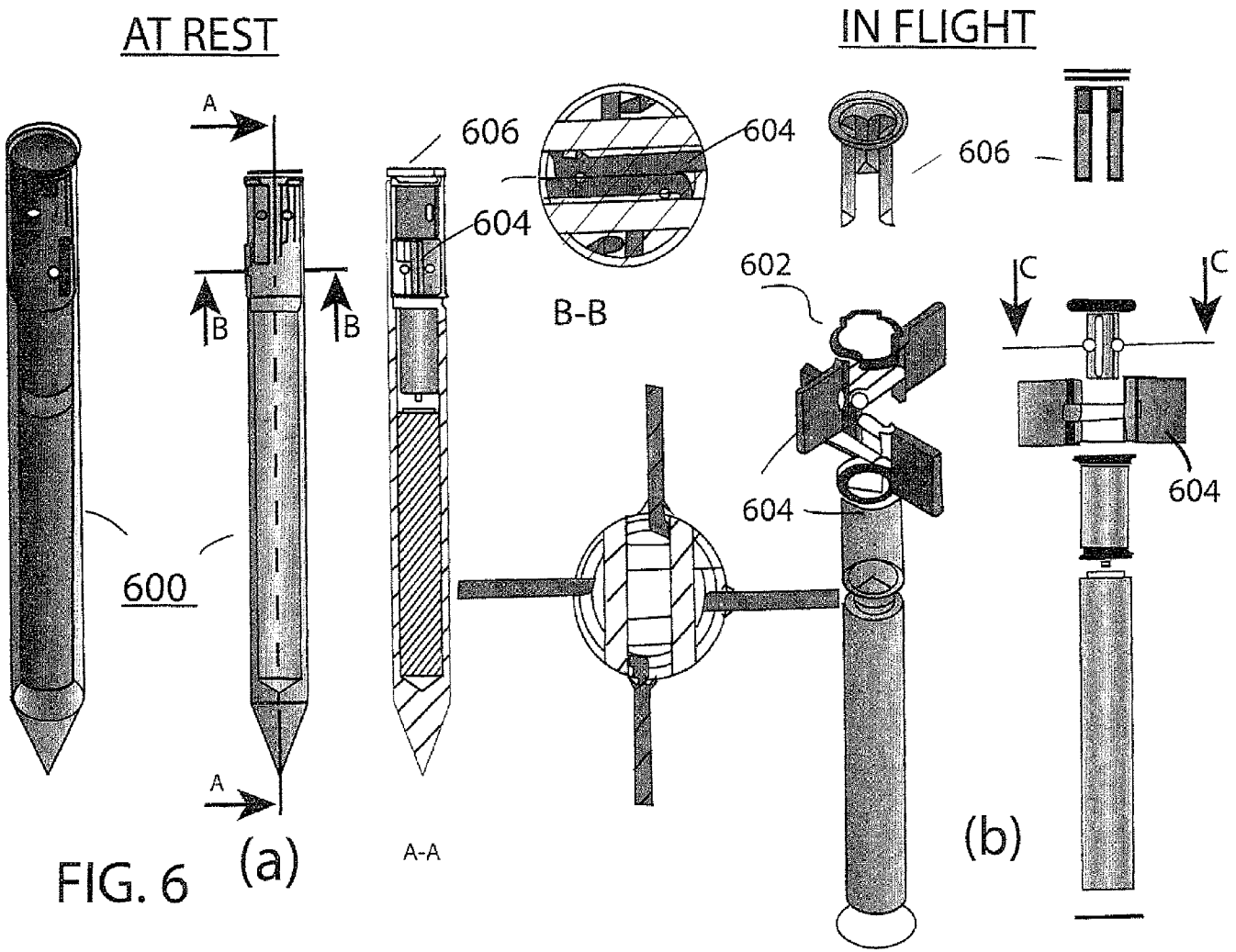
FIG. 6 shows an embodiment of an arrow having an extendable centrifugal (radial) fin stabilizing mechanism: (a) as packed at rest and (b) in flight.

FIG. 6 shows an embodiment of an arrow 600 having an extendable centrifugal radial fin stabilizing mechanism 602, (a) at rest and (b) in flight. Stabilizing radial fins 604 are originally contained within a tail section of the arrow envelope and capped by a cap 606. In flight, centrifugal forces cause radial fins to extend radially outwards from the envelope, providing the stabilizing action.

Figure 7:
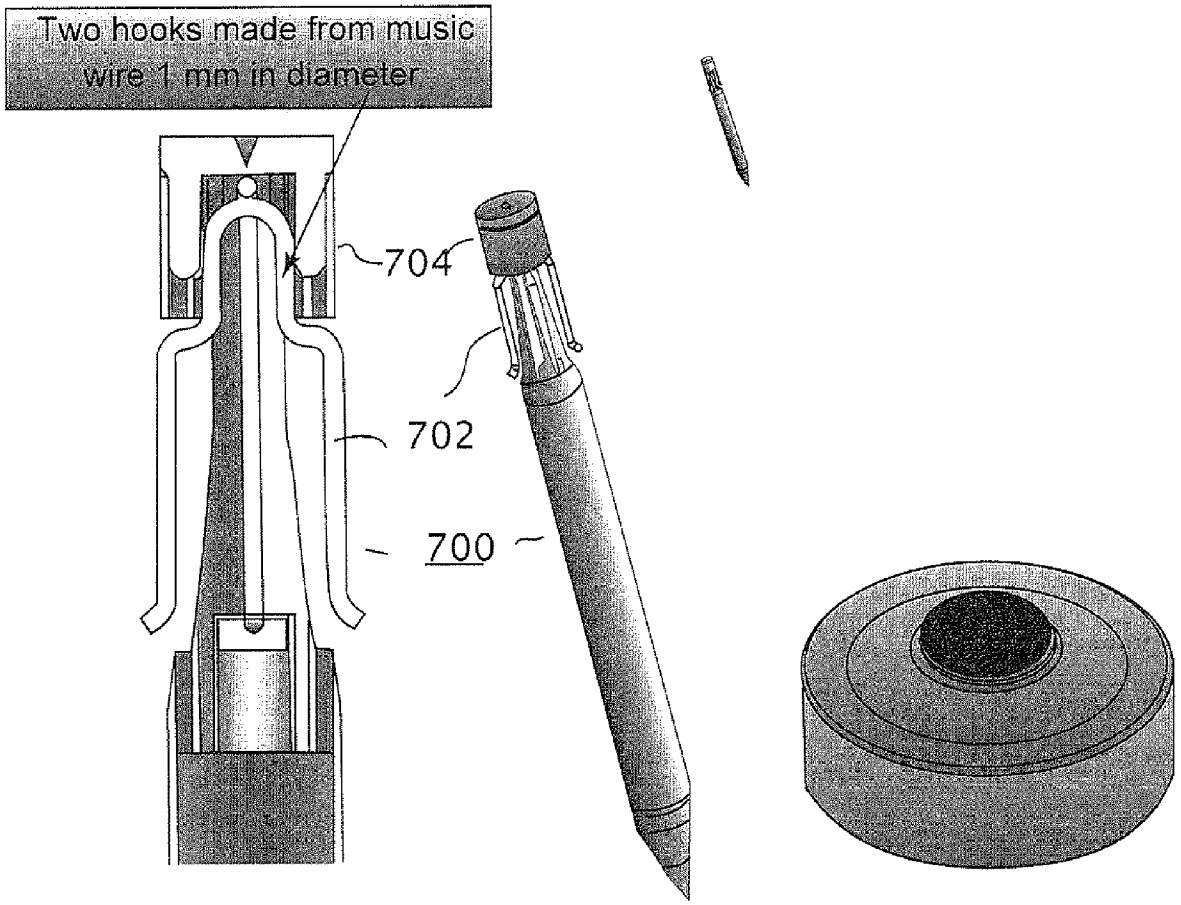
FIG. 7 shows an embodiment of an arrow having a spring stopping mechanism: (a) as packed, (b) in flight, (c) and (d) after hitting a target.
Figure 7B:
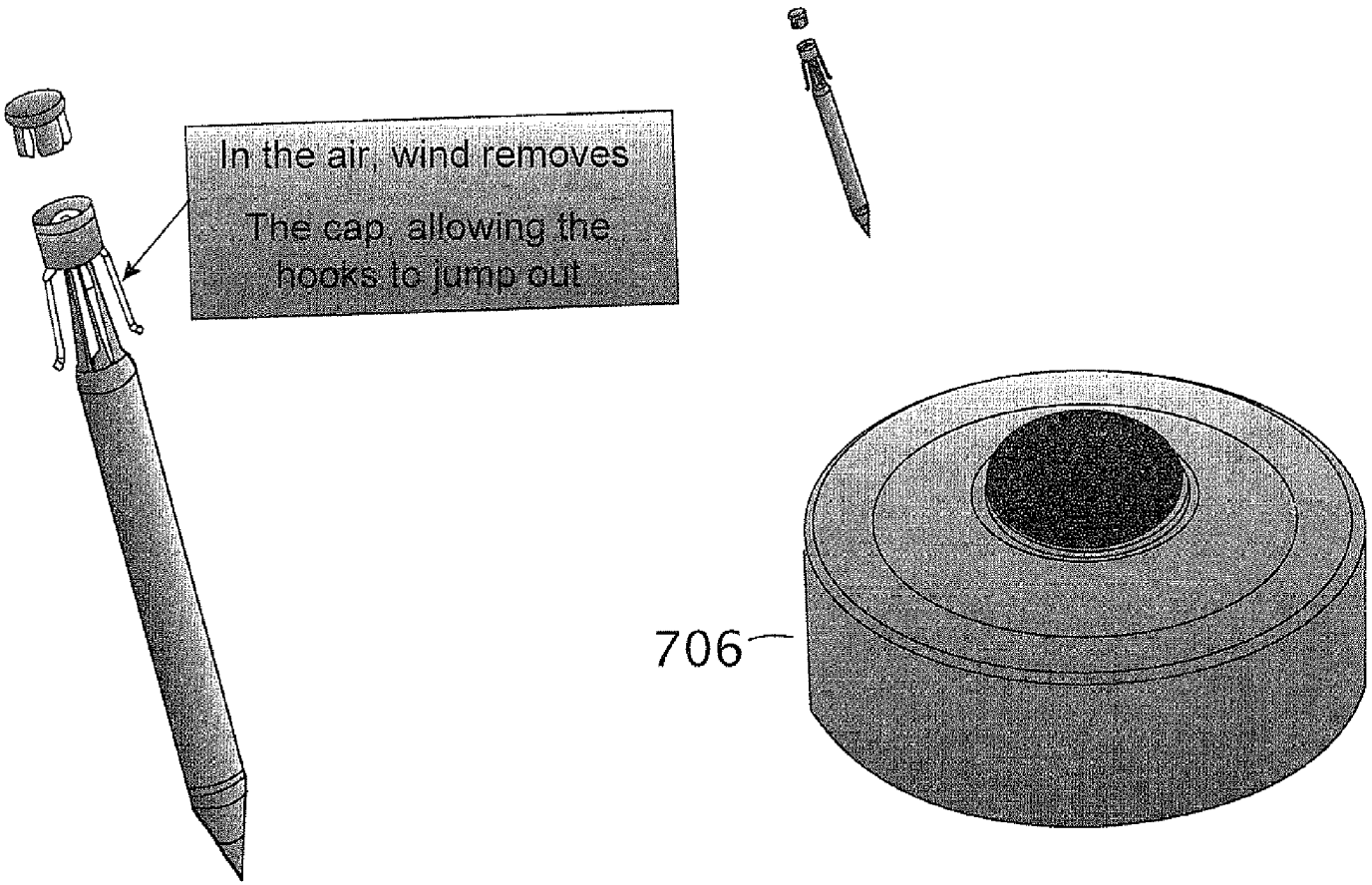
Figure 7:
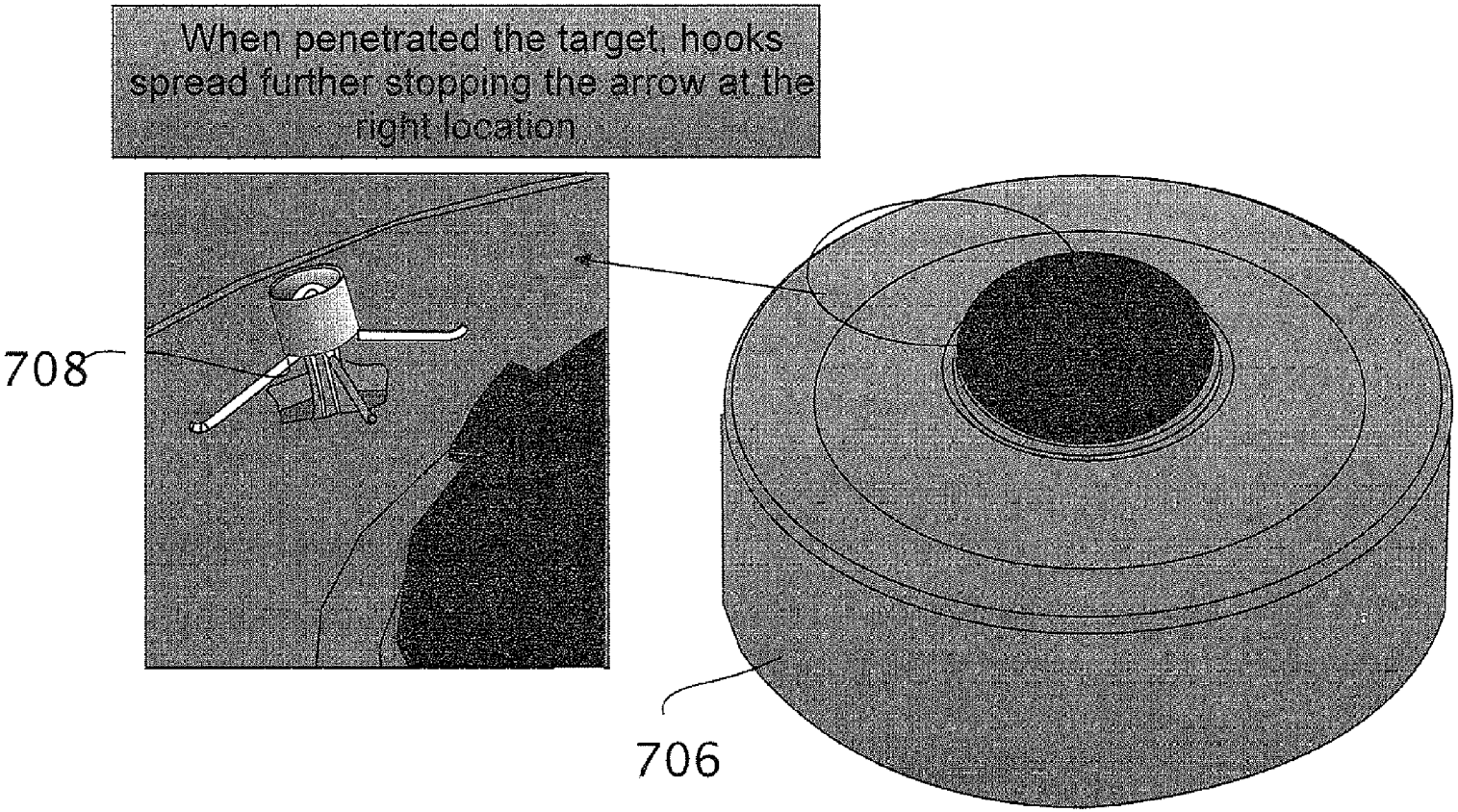
Figure 7:
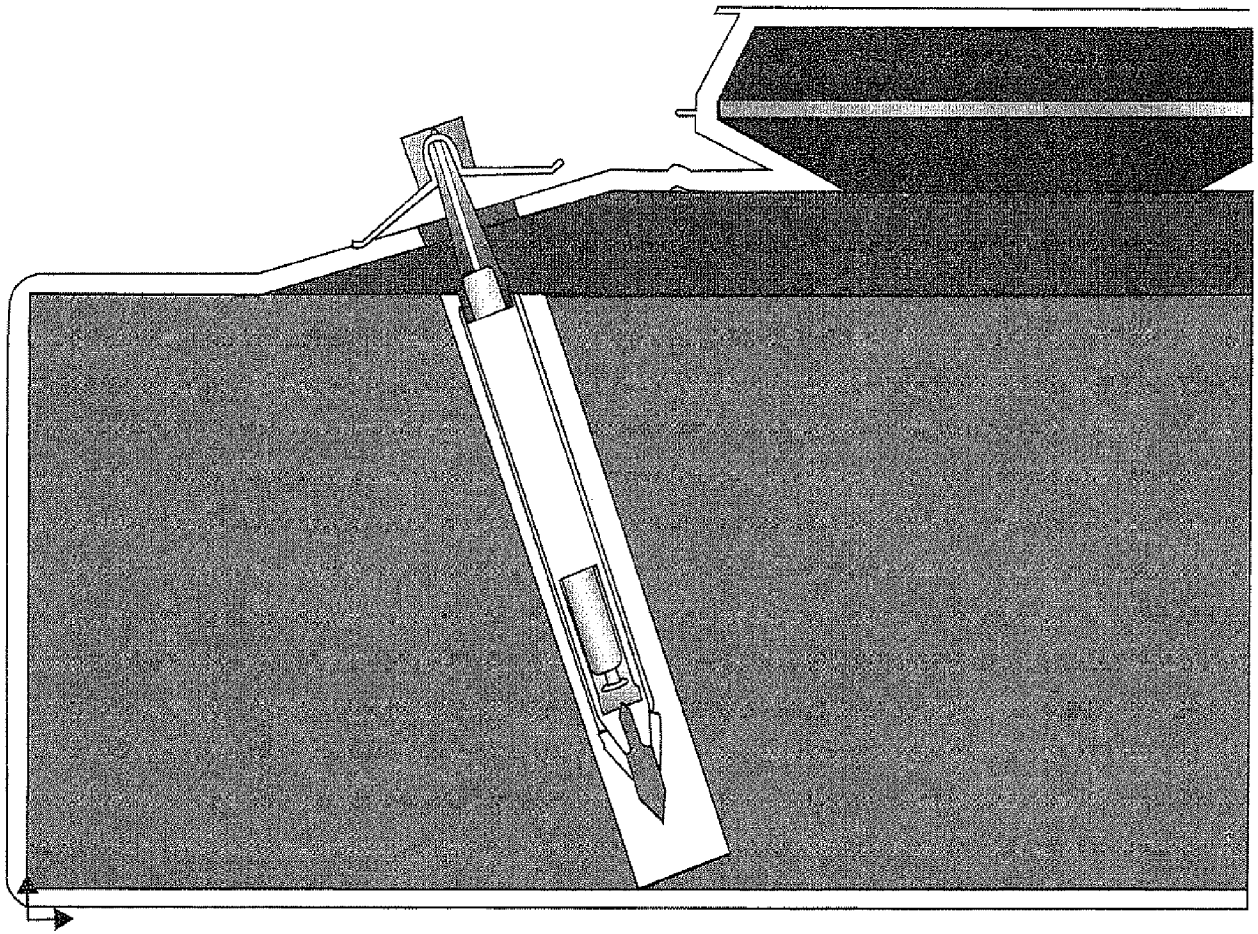
Figure 7:
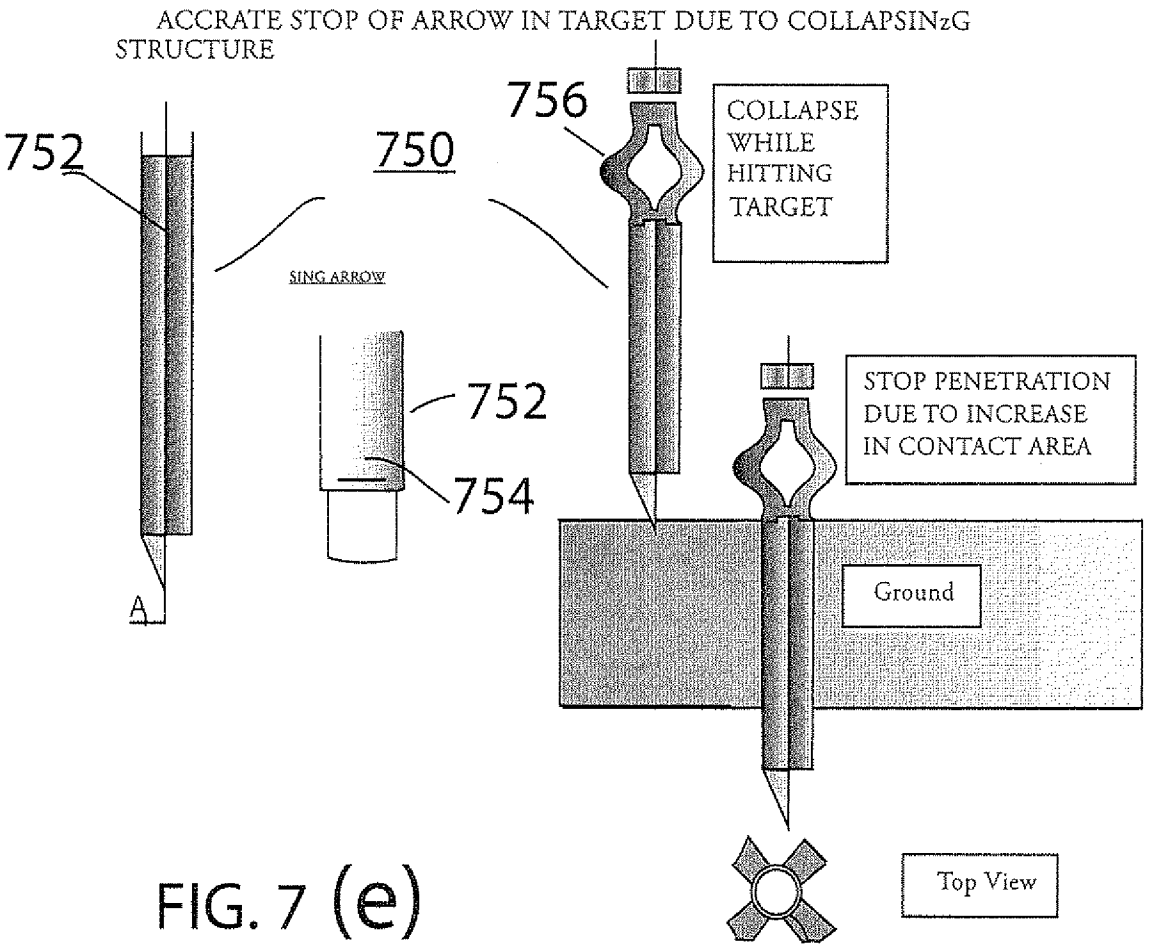

FIG. 7 shows an embodiment of an arrow 700 having a spring or "hook" stopping mechanism including spring wires 702 attached to a cap (exemplarily made of plastic) 704. The wires may exemplarily be heat-treated wires with a diameter of 1 mm. When the arrow is packed (FIG. 7*a*), the cup compresses the wires, enclosing them within the fins of the arrow. When released (FIG. 7*b*), the wires spring out of the body perimeter extending to a natural spring position. When the arrow hits a target such as a mine 706 (FIG. 7*c*), the wires are extended further, creating a cross formation 708 on the target surface, thereby helping to stop the arrow. The stopped arrow is shown in more detail in FIG. 7*d*.

In yet another embodiment shown in FIG. 7(*e*), the arrow has a collapsing tail structure that fulfills a similar "stopping" role to that of spring wires 702. FIG. 7(*e*) shows an arrow 750 with a collapsing tail section 752. Section 752 has elongated grooves formed in the envelope (exemplarily 4 grooves positioned symmetrically around the envelope perimeter). The grooves allow section 752 to collapse when the arrow hits the target, thereby forming a stopping formation 756 similar to cross formation 708. Note that the collapsing tail structure may be combined with any of the various stabilizing mechanisms disclosed herein.

Figure 8:
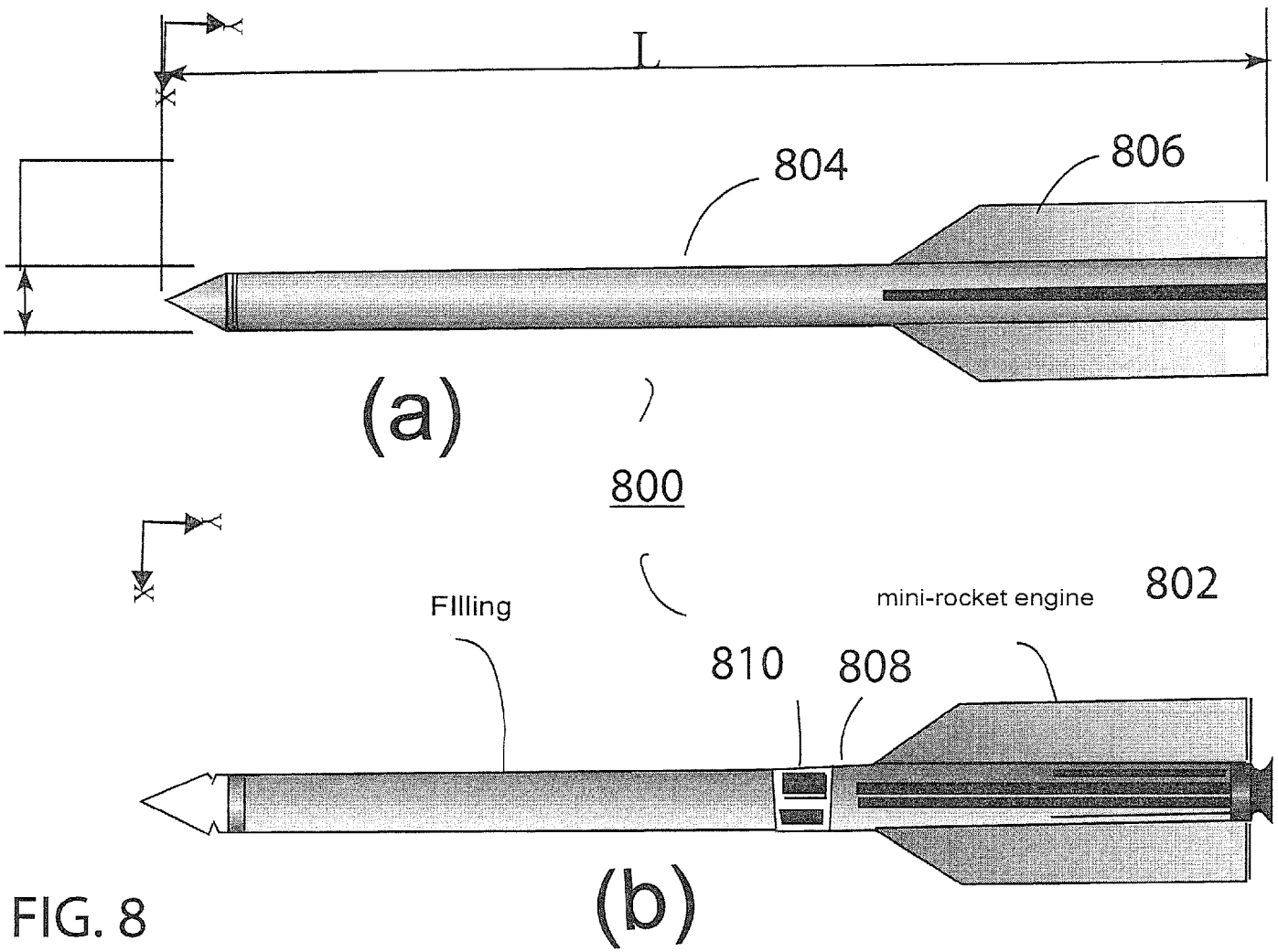
FIG. 8 shows in (a) an embodiment of an arrow having a miniaturized rocket propelling engine and in (b) details of the mini-rocket engine.

FIG. 8 shows in (a) an embodiment of an arrow 800 having a miniaturized rocket propelling engine 802 ("mini-rocket arrow"). Arrow 800 is preferably made from a single piece tube 804 with attached (e.g. welded) stabilizing fins 806. An insulating barrier 808 is positioned between engine 802 and an incinerator 810. Engine 802 provides the necessary kinetic energy for the arrow launched from an arrow launcher to reach and penetrate its target. Enabling details for its construction are given in FIG. 8(*a* ).

Figure 9:
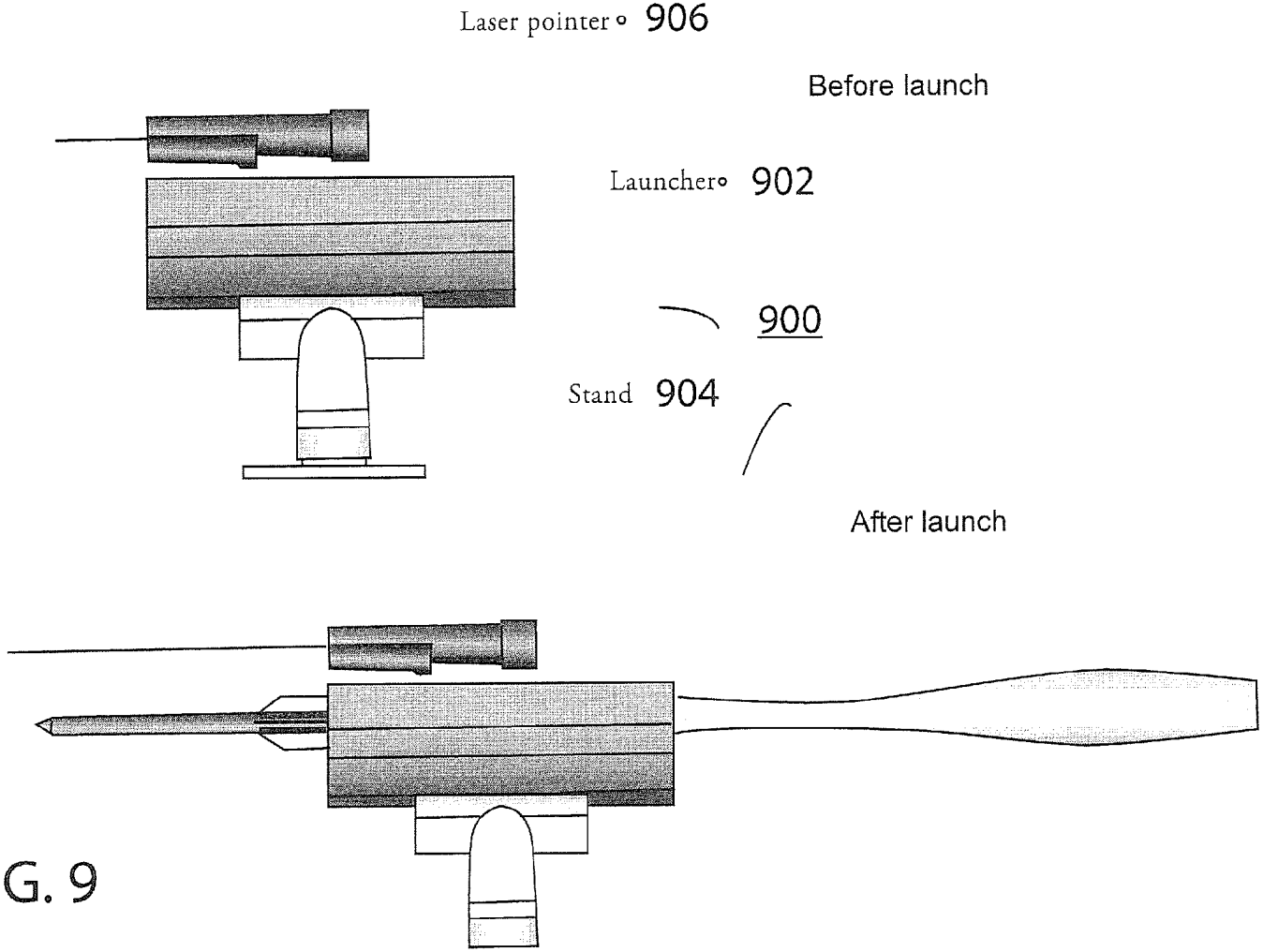
FIG. 9 shows an exemplary single tube launcher for the arrow of FIG. 8.

The mini-rocket arrows may be propelled from any known system, including single tube launchers and multi-tube launchers. FIG. 9 shows a single launcher 900 for the mini-rocket arrow that includes a launcher tube 902 positioned on a stand 904 that may have one or more degrees of freedom (tilt and pan) and a laser pointer 906. Before launch, the arrow is positioned inside the launcher tube. After launch, the arrow exits the tube, the mini-rocket is ignited and propels the arrow to its target.

Figure 10:
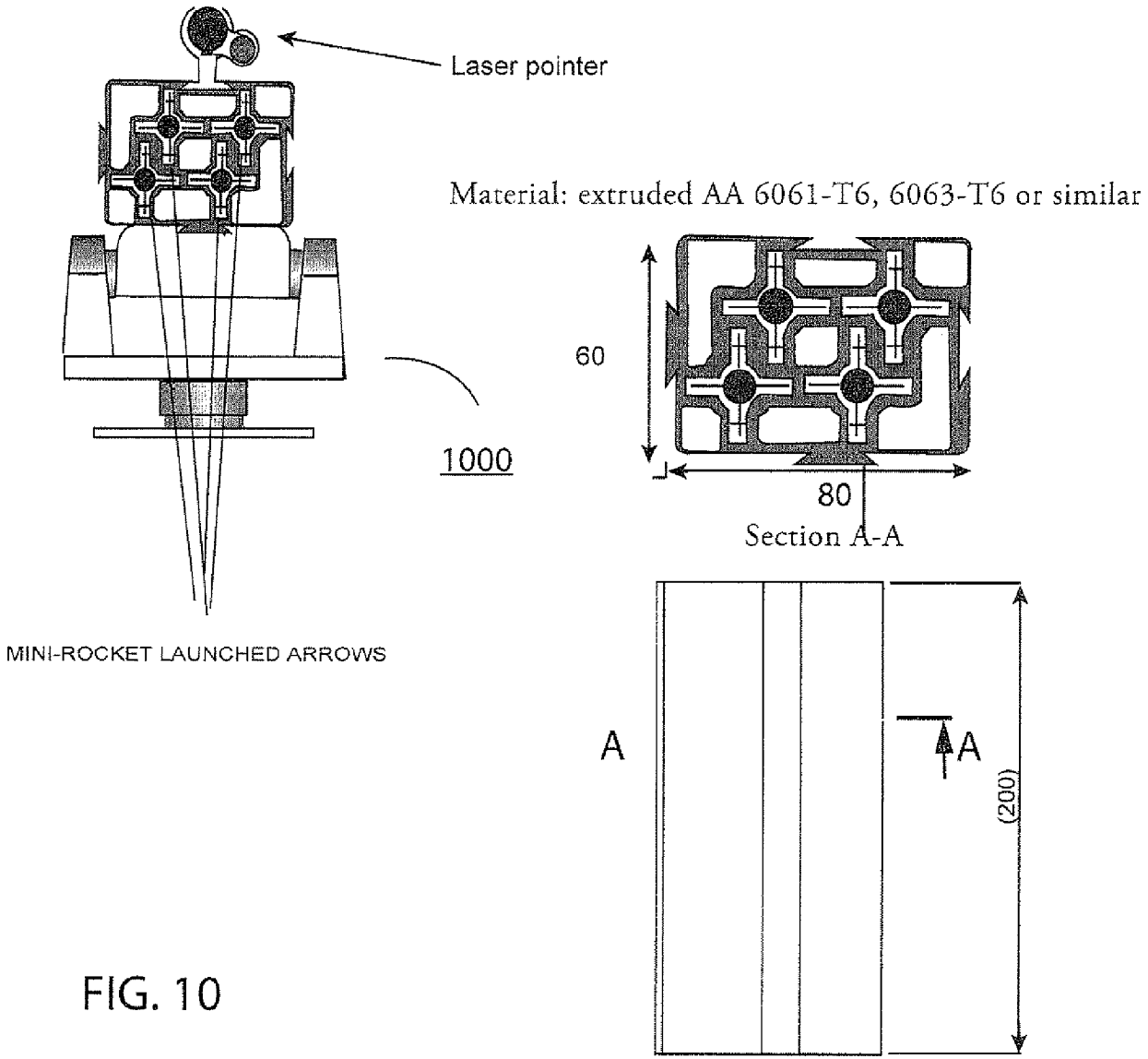
FIG. 10 shows an exemplary multiple tube launcher for the arrow of FIG. 8.

FIG. 10 shows a multiple launcher (for 4 arrows) 1000 with typical dimensions (in cm) and materials. The technical data is for illustrative and enablement purposes only. It would be clear to one skilled in the art that there may be many ways to design the mini-rocket arrow and its various launchers. For example, the multiple arrow launcher may be made modular, to include multiple units of the 4 tubes shown in FIG. 10. The principles of launching rockets are well known, and each of systems 900 and 1000 may include other components well-known in rocket launchers, adapted for the smaller size of the mini-rocket arrows.

All patents mentioned in this specification are herein incorporated in their entirety by reference into the specification, to the same extent as if each individual patent was specifically and individually indicated to be incorporated herein by reference. In addition, citation or identification of any reference in this application shall not be construed as an admission that such reference is available as prior art to the present invention.

While the invention has been described with respect to a limited number of embodiments, it will be appreciated that many variations, modifications and other applications of the invention may be made. For example, while described in detail with respect to uses against mines and unexploded ordnance, the arrows disclosed herein are equally useful against flying projectiles, missiles or rockets.

What is claimed is:

1. An arrow-type warhead comprising:

a. an incendiary envelope;

b. a filling, including a pyrophoric material in the form of a metal oxide and a metal powder, and disposed within the envelope and primed to undergo a reaction with the envelope upon impact of the arrow on a target, whereby both envelope and filling are consumed in the reaction to provide a desired destructive effect;

c. a stabilizing mechanism for stabilizing the warhead in flight;

d. a mini-rocket propulsion mechanism, aft of said filling, for propelling the warhead to the target;

e. a hardened head section for promoting penetration of the target;

f. an igniter mechanism for setting off the pyrophoric material; and g. a stopping mechanism disposed to stop the warhead at a predetermined position relative to the target upon impact.

2. The warhead of claim 1, wherein the metal is aluminum or magnesium, wherein the oxide is respectively an aluminum or a magnesium oxide and wherein the envelope is made of respectively aluminum or magnesium.

3. The warhead of claim 1, wherein the metal oxide has a composition above the stoichiometric ratio, thereby leading to an exothermic reaction with the envelope upon the impact.

4. The warhead of claim 1, wherein the envelope and the stabilizing mechanism form a unibody structure.

5. The warhead of claim 4, wherein the stabilizing mechanism includes a fixed fin structure.

6. The warhead of claim 1, wherein the stabilizing mechanism is selected from the group consisting of a stabilizing cup, a stabilizing cone, a stabilizing band and centrifugal foldable radial fins.

7. The warhead of claim 1, wherein the stopping mechanism is a spring mechanism.

8. The warhead of claim 1, wherein the stopping mechanism is a collapsible tail mechanism.

9. An arrow-type warhead comprising:

a. an envelope;

b. an explosive filling;

c. a hardened head section for promoting penetration of a target;

d. a stabilizing mechanism for stabilizing the warhead in flight;

e. a mini-rocket propulsion mechanism, aft of said filling, for propelling the warhead to said target; and f. a stopping mechanism disposed to stop the warhead at a predetermined position relative to the target upon impact.

10. The warhead of claim 9, wherein the envelope and the stabilizing mechanism form a unibody structure.

11. The warhead of claim 10, wherein the stabilizing mechanism includes a fixed fin structure.

12. The warhead of claim 9, wherein the stabilizing mechanism is selected from the group consisting of a stabilizing cup, a stabilizing cone, a stabilizing band and centrifugal foldable radial fins.

13. The warhead of claim 9, wherein the stopping mechanism is a spring mechanism.

14. The warhead of claim 9, wherein the stopping mechanism is a collapsible tail mechanism.

15. An arrow-type warhead comprising:

a. an incendiary envelope;

b. a filling disposed within the envelope and primed to undergo a reaction with the envelope upon impact of the arrow on a target, whereby both envelope and filling are consumed in the reaction to provide a desired destructive effect;

c. a hardened head section for promoting penetration of the target;

d. a stabilizing mechanism for stabilizing the warhead in flight;

e. an igniter mechanism for setting off the pyrophoric material; and f. a stopping mechanism disposed to stop the warhead at a predetermined position relative to the target upon impact.

16. An arrow-type warhead comprising:

a. an envelope;

b. an explosive filling;

c. a hardened head section for promoting penetration of the target;

d. a stabilizing mechanism for stabilizing the warhead in flight; and e. a stopping mechanism disposed to stop the warhead at a predetermined position relative to the target upon impact.

* * * * *